US005865120A

United States Patent [19]

Gross

[11] Patent Number: 5,865,120

[45] Date of Patent: Feb. 2, 1999

[54] DIAGNOSTIC SYSTEM

[75] Inventor: Reinhard Georg Gross, Würzburg, Germany

[73] Assignee: Koenig & Bauer-Albert Aktiengesellschaft, Wurburg, Germany

[21] Appl. No.: 928,332

[22] Filed: Sep. 12, 1997

[30] Foreign Application Priority Data

Sep. 12, 1996 [DE] Germany ..... 196 36 987.8

[51] Int. Cl.[6] ..... B41F 5/00

[52] U.S. Cl. ..... 101/483; 101/216; 101/181

[58] Field of Search ..... 101/216, 219, 101/212, 181, 483

[56] References Cited

U.S. PATENT DOCUMENTS

| | | | |
|---|---|---|---|
| 3,713,571 | 1/1973 | Simonton | 226/2 |
| 4,528,630 | 7/1985 | Sargent | 364/469.04 |
| 5,479,885 | 1/1996 | Christoph et al. | 101/174 |
| 5,615,609 | 4/1997 | Hill et al. | 101/183 |
| 5,678,159 | 10/1997 | Williams et al. | 399/395 |

FOREIGN PATENT DOCUMENTS

| | | |
|---|---|---|
| 41 37 979 | 5/1993 | Germany . |
| 195 05 692 | 8/1996 | Germany . |

OTHER PUBLICATIONS

*Papier und Druck* 32; "Erhöhung der Zuverlässigkeit Polygrafischer Maschinen Durch Technische Diagnose"; (1983); pp. 100–104.

*Primary Examiner*—Edgar S. Burr
*Assistant Examiner*—Dave A. Ghatt
*Attorney, Agent, or Firm*—Jones, Tullar & Cooper, P.C.

[57] ABSTRACT

A diagnostic system for a rotary printing press utilizes signals from angular position detectors on press components to identify wear patterns. These signals are compared to press-idiosyncratic operating patterns and changes between the two are analyzed to provide information on press component wear.

11 Claims, 2 Drawing Sheets

DIAGNOSTIC SYSTEM

FIELD OF THE INVENTION

The present invention is directed generally to a diagnostic system. More particularly, the present invention is directed to a diagnostic system for a rotary printing press. Most specifically, the present invention is directed to a diagnostic system usable to determine wear or damage of components in a rotary printing press. At least one cylinder and more typically two cooperating cylinders of the rotary printing press are provided with angular position detectors. A signal is generated which is an accurate indicator of the relative angular position of each cylinder or moving component. The signal is compared with a reference signal. Any relative change between the signal generated by the angular position detector and the reference signal will be used as a measure of wear or damage of the moving component or components. Wear patterns can be established and maintenance can be scheduled based on this diagnostic system.

DESCRIPTION OF THE PRIOR ART

In the field of rotary printing, it is typical to print a web or sheet through the cooperative efforts of a large number of rotating cylinders and rollers. In many press assemblies two or more cylinders will cooperate with each other to print a sheet or web as it passes between the cylinders. To insure proper printing, it is important to detect wear of these cylinders or rollers, or of their bearings or other supports, and to repair or replace items before they become worn to the point that they have an adverse effect on print quality. Various maintenance schedules and protocols have been developed in an effort to accomplish repair or replacement of press items before the print quality deteriorates. Too frequent maintenance increases costs and reduces production output. Too infrequent maintenance risks print quality degradation and possible unscheduled shut-downs.

Principles of various diagnostic procedures for printing presses generally at set forth in a publication entitled *Papier Und Druck* 32(1983)7. In an article that is set forth at pages 100–104 of that publication there are presented generalities regarding a number of diagnostic principles for printing presses. However this article does not discuss or suggest the utilization of information regarding the angular position or relative angular positions of rotatable components in a rotary printing press for diagnostic purposes. These diagnostic procedures, as discussed in this article do not allow deviations in angles of rotation of various rotary printing press components to be detected with sufficient adequacy to be effective.

In the German patent document No. DE 41 37 979 Al there is disclosed a printing press drive. This drive includes an angular position detector at each printing unit. The signal errors from the several angular position detectors are all initially compared to a setpoint and are used to regulate the printing units, typically to insure proper register of the several printing units. The setpoint that is used as the basis of comparison for the printing units is determined by the utilization of knowledge of an earlier value provided by the angular position detectors.

The prior art devices do not provide a diagnostic system, which uses angular positions of rotating press components to ascertain component wear or damage. The diagnostic system in accordance with the present invention overcomes the limitations of the prior art and is a significant advance in the art.

SUMMARY OF THE INVENTION

It is an object of the present invention to provide a diagnostic system.

Another object of the present invention is to provide a diagnostic system for a rotary printing press.

A further object of the present invention is to provide a diagnostic system usable to determine wear or damage of components in a rotary printing press.

Still another object of the present invention is to provide a printing press diagnostic system that uses angular position detectors.

Yet a further object of the present invention is to provide a printing press diagnostic system that can forecast scheduled maintenance.

As will be discussed in detail in the description of the preferred embodiment which is presented subsequently, the diagnostic system for a rotary printing press in accordance with the present invention utilizes angular position detectors which will monitor the angular position of various press cylinders and rollers. Signals from these detectors will be processed through a suitable control unit and analyzed over a specified time period. A reference pulse can be provided and the signals from the angular position detectors will be compared to the reference signal. Changes between the two will be indicative of the changes of the angular position of the components and can be caused by vibrations, wear or other causes. If the deviations form a regular pattern, this may merely be the given press-idiosyncratic pattern of the machine during its operation. If these deviations change over time and do not repeat, then they are probably the result of component wear. If a pattern of increasing wear is detected, the required maintenance or repair can be accomplished during a shut-down of the machine due to other causes. Alternatively, the rate of wear can be charted and an appropriate periodic maintenance schedule can be established.

The ability to schedule maintenance based on a knowledge of component wear will insure that maintenance is done when it is needed. Premature maintenance will be avoided and the necessary repairs or replacements of worn components can be accomplished during any shutdown times. This will keep production outages, due to wear, at a minimum.

There currently exist rotary printing presses that utilize printing units, each of which is provided with its own drive motor. These drive motors are typically position controlled. It is possible to use the output of the angular-momentum detectors that are already in place and that are used to regulate the drive motors, to also function as a diagnostic system. The utilization of these already existing angular-position detectors or generators thus keeps the complexity and the cost of the diagnostic system relatively low.

By using only one angular position detector for each printing unit, conclusions regarding the state of wear of the entire printing unit can still be reached. Even those components which are not provided with angular position detectors can have their rates of wear determined since the adjacent components, which interact with their components will be provided with angular position detectors.

The output signals from the various angular position detectors can be processed into suitable frequency spectrums or patterns. By associating typical frequencies with given components and by noting changes, a conclusion can be drawn about the wear or damage that a particular component is showing.

It will thus be seen that the diagnostic system for a rotary printing press accordance with the present invention overcomes the limitations of the prior art. It is a substantial advance in the art.

BRIEF DESCRIPTION OF THE DRAWINGS

While the novel features of the diagnostic system for a rotary printing press in accordance with the present invention are set forth with particularity in the appended claims, a full and complete understanding of the invention may be had by referring to the detailed description of the preferred embodiment, as presented subsequently, and as illustrated in the accompanying drawings, in which:

DETAILED DESCRIPTION OF THE PREFERRED EMBODIMENT

Figure 1:
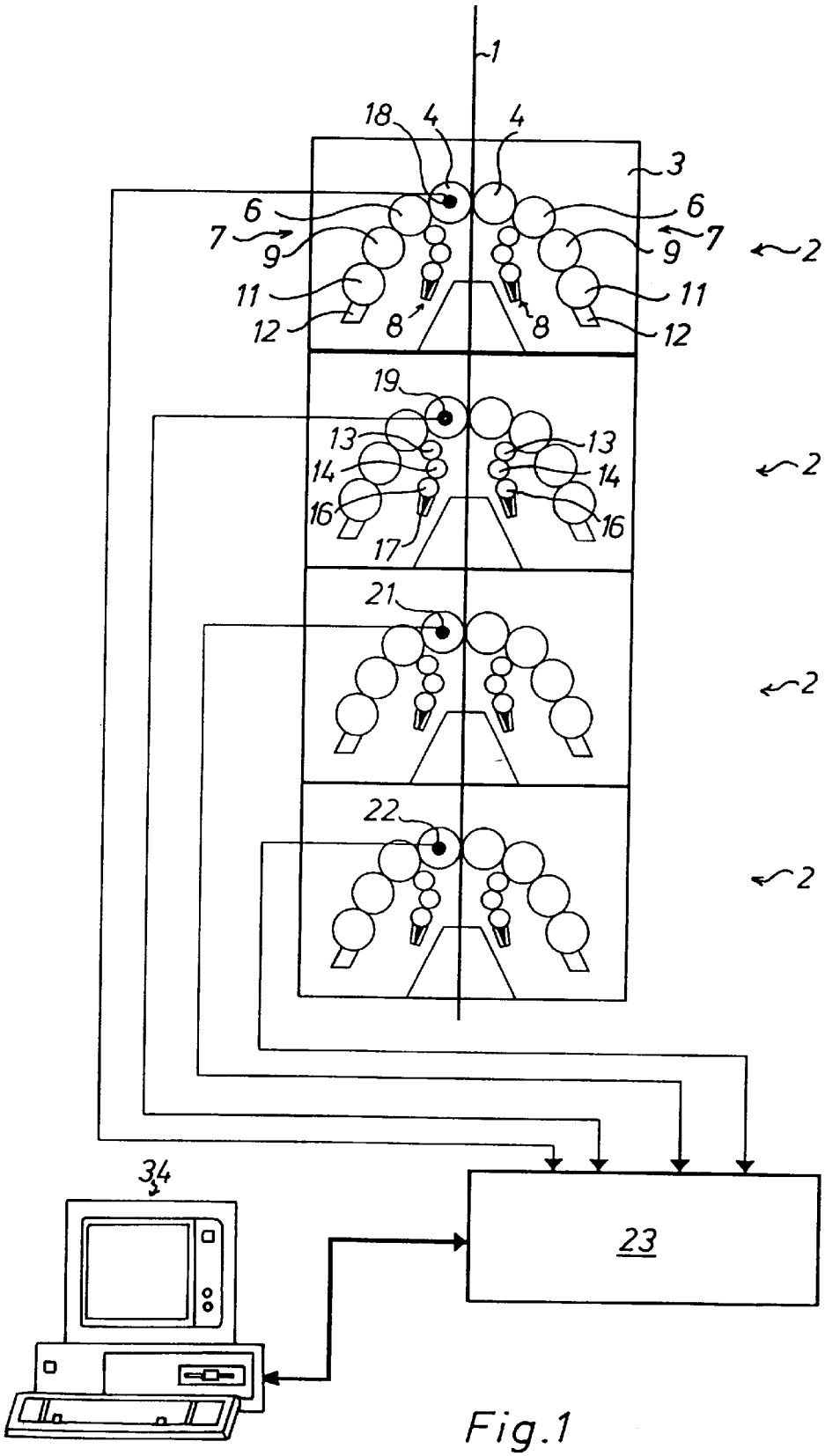
FIG. 1 is a schematic view of a printing unit of a rotary printing press with a diagnostic system in accordance with the present invention.

Referring initially to FIG. 1, there may be seen a portion of a rotary printing press in which the diagnostic system in accordance with the present invention is intended for use. This rotary printing press utilizes a plurality of printing unit pairs 2 to print a web 1 which passes between the cooperating pairs of these printing unit pairs 2. The web 1 is thus printed on both of its sides as it passes through each printing unit pair 2. There are four such printing units 2 depicted in FIG. 1 and they are arranged in a tower arrangement as so-called bridge printing units. This means that each such printing unit pair is situated symmetrically with respect to the path of travel of the web 1 which is to be printed. Each of these printing unit pairs 2 includes a rubber blanket cylinder 4 with the two cooperating blanket cylinders 4 in each printing unit pair 2 defining a print zone through which the web 1 passes. Each rubber blanket cylinder 4receives its ink image from a plate cylinder 6 which is in contact with an inking system 7 and a damping fluid system 6. All of these various cylinders are supported for rotation between side frames 3of the rotary printing press.

As may be seen in FIG. 1, each inking system 7 is a so-called short or anilox inking system and employs an ink transfer roller 9that is in contact with the cooperating plate cylinder 6 of each printing unit 2. The ink transfer roller receives ink from a screened surface roller 11 that is provided with ink from an ink reservoir defined by doctor blades 12. Such an anilox or a short inking system is generally well known in the art.

Each damping or moistening system 8 is also generally conventional and, as may also be seen in FIG. 1 includes a train of three damping fluid transfer rollers 13, 14 and 16. These three rollers 13, 14 and 16 are provided with a suitable damping fluid from a spray system 17. The upper-most damping fluid transfer roller 13 contacts the plate cylinder 6 of each of the print unit pairs in each printing unit 2.

In each of the printing units 2, the rubber blanket cylinder 4 and its associated plate cylinder 6 are in driving connection by suitable gears that are not specifically depicted. Each of the printing units 2 is provided with its over drive motor which again is not specifically depicted in FIG. 1. The printing unit drive motor for each of the printing units 2 can be directly connected to one of the rubber blanket cylinders 4, for example. Alternatively, each printing unit drive motor could drive its associated cylinders through an arrangement of intermediary gears, such as an intermediary pinion gear.

As is shown somewhat schematically in FIG. 1, one of the rubber blanket cylinders 4 in each of the bridge printing units 2is provided with a suitable angular position detector 18, 19, 21 or 22. This angular position detector, which could be an angular momentum detector, such as an incremental angular position detector will be capable of very accurately providing information regarding the angular position of the rubber blanket.

The printing units 2 may each be provided with their own drive motors, as discussed above. Alternatively, the several printing units 2 in the lower printing assembly could be all driven by a ganged drive shaft. In another possible arrangement, each intermediate rubber blanket cylinder 4 and each individual plate cylinder 6 could be provided with its own drive motor. Also, each of the various rubber blanket cylinders 4 and each of the individual plate cylinders 6 could be provided with its own angular position detectors, such as the angular momentum detectors 18, 19, 21 and 22 which are schematically depicted in FIG. 1.

Figure 2:
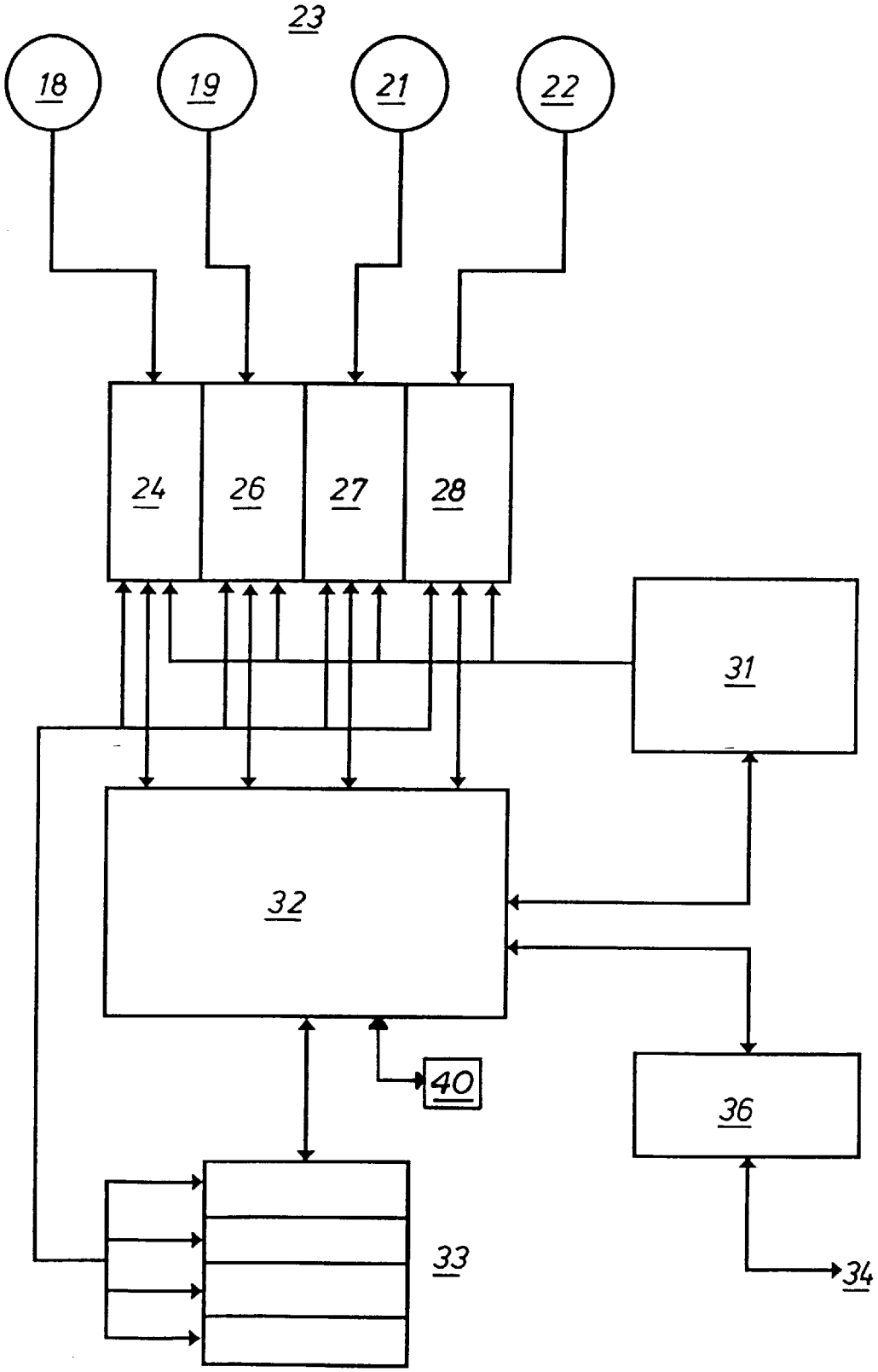
FIG. 2 is a schematic depiction of the diagnostic system.

In the preferred embodiment of the diagnostic system in accordance with the present invention, as seen in FIG. 2, an analyzing system 23 is essentially composed of four measurement circuit cards 24, 26, 27 and 28, each associated with a corresponding one of the angular-momentum detectors 18, 19, 21, 22; a time base or clock 31; a control unit 32; a data storage device 33; and a digital I/O card 36. The tour measurement circuit cards 24, 26, 27, 28 are essentially counter circuits which are synchronized by the time base 31, and measure the time at which each signal pulse is generated by the corresponding one of the 25 detectors 18, 19, 21, 22. The measurement circuit cards 24, 26, 27, 26 are fitted with adaptation means for instance to adjust the number of signal pulses measured for the particular angular-momentum detector 16, 19, 21, 22 and a dataflow check between the measurement circuit cards 24, 26, 27, 26 and the data storage device 33. The measurement circuit cards 24, 26, 27, 28 are interfaced to the control unit 32. Moreover this control unit 32is linked with the time base 31, the data storage device 33 and the digital I/O card 36. The control unit 32 comprises a reference synchronization means for a start pulse which starts the counting of all of the measurement circuit cards 24, 26, 27, 28simultaneously Moreover the control unit 32 controls the measurement interval, a number of revolutions, the time base 31, and feeds data to the I/O card 36. The data storage device 33 is also connected with each measurement circuit card 24, 26, 27, 28. The digital I/O card 36 interfaces the analyzing system 23 with a computer 34. Adjustments of the control unit 32 and data transmission are implemented by the computer 34 through the I/O card 36.

Illustratively, the angular-momentum detectors 18, 19, 21 and 22 each generate three signals by means of an index disk scanned by opto-electronic transducers. The first signal provides a reference pulse, the other two signals, which are mutually shifted in phase by 90°, provide for instance 4,096 separate pulses per revolution. The reference signal and the two signals are fed to the analyzing system 23 which records all signals synchronously in time. An as additional reference signal also is fed to the analyzing system 23. This reference signal consists of a time- constant pulse train having a constant frequency which is substantially higher than the signal frequencies from the angular momentum detectors 18, 19, 21, 22. This high-frequency reference signal is generated by an oscillator 40, for instance a quartz-crystal oscillator, which is interfaced to the control unit 32.

Signals can be selectively compared by the computer 34. For instance, the signals from angular-momentum detectors 18, 19, 21, 22 of two rubber blanket cylinders 4 may be compared during one or several cylinder revolutions. The comparison signal so generated 10 from the two rubber blanket cylinders 4 is a measure of the relative motion, i.e., the relative angular deviation between these two rubber blanket cylinders 4, and thereby corresponds to a register deviation of the sheet 1. When relating the signals from the angular-momentum detector to the reference signal of the is oscillator 40, the comparison signals so obtained are a measure of the absolute angular deviation, i.e., the absolute deviation of the peripheral speed of the rubber blanket cylinders 4. This comparison signal reveals the deviation function of the rubber cylinder 4 from a uniform rotation on account of rotational fluctuations, that is, it reveals the accurate (preferably to 0.001to 0.01°) angular position of the rubber blanket cylinder 4. These rotational fluctuations illustratively may be caused by inherent vibrations of the rubber blanket cylinder 4, by defects in the gears, by vibrations in the bearing of the rubber blanket cylinder 4, by transmitted vibrations from neighboring cylinders or by load fluctuations. Each cylinder 4, 6 of a printing unit 2 evinces a typical deviation function relative to uniform rotation. For instance within one printing unit 2 these deviations from uniformity of the cylinders 4, 6 may be combined into groups, which, while resembling a given pattern, need not be absolutely equal This uniformity comparison signal of the cylinders 4, 6 is fed to the computer 34 where it is compared with stored, press-idiosyncratic determined reference signals for given production conditions, for instance the number of the printing units being printing, the sheet material being used, or the like. These press-idiosyncratic reference signals or pattern signals for instance were previously stored for various conditions of production and for a rotary printing press which was operating flawlessly when in a wear- and damage-free state, or they were ascertained theoretically and determined that way. To implement the comparison, both the is uniformity of the comparison signal of the signals 4, 6 and the pattern's signals may be processed. Illustratively, a Fast Fourier Transform (FFT) may be used to resolve the signals into frequency spectra with their associated amplitudes. It was found advantageous to relate these frequency spectra not to time but to the cylinder revolutions because most motions in a rotary printing press take place periodically relative to a cylinder revolution. In this procedure, the amplitudes of the rotational vibrations related to cylinder revolutions are ascertained and compared. Using FFT, it is possible to resolve either each signal into its frequency spectra, or only the deviation of the reference signal into its frequency spectrum, and then to evaluate them. The comparison of the measurement signals with the reference signals can take place continuously or in given time intervals.

If one or more amplitudes of the measurement-signal frequency-spectrum do change, the cause may be ascertained on the basis of frequency. Illustratively, damage to components such as gears or cylinder bearings can be ascertained by such frequency analysis. For instance, wear of the teeth of a gear can be spotted in a frequency spectrum corresponding to a multiple of the cylinder revolutions related to the number of teeth. It is possible furthermore to spot continuing wear of cylinder bearings and thereby to predetermine maintenance intervals.

The deviation of the actual angular position of a cylinder or the deviation of the relative angular positions of two cylinders from the associated press-idiosyncratic reference signal is taken as a measure of wear or damage of components.

This wear of given components is continuously monitored and is communicated to an operator for instance on a screen of a control station. Thereupon the operator must acknowledge the wear information when a first limit value, set for instance by the press manufacturer, is reached, and he must release the press manually. When reaching a second limit value the press or at least the particular unit must be shut down.

In the preferred embodiment of the present invention, as discussed above, the angular-momentum or position detectors 18, 19, 21 and 22 required to regulate the printing units 2 are used to generate the measurement signals. Furthermore angular momentum detectors 18, 19, 21, 22 of other unite such as roller changers, crawl units or folding devices may be used for evaluation to reach conclusions on the wear of specific, periodically moving components of these units. Illustratively it is possible to ascertain a cutting force of a cylinder, for instance a cutting cylinder, participating in cutting, in the folding apparatus and conclusions may then be drawn on the wear for instance of the blades or cutting sticks.

Besides the angular-momentum detectors 18, 19, 21, 22 required for the drive motors, further angular-momentum detectors may be fitted to periodically moving, for instance rotating components, for instance on all cylinders 4,.6.

The measurement signals, or their analysis, can be stored. Where required, the stored data may be retrieved and transmitted, e.g., by modem or ISDN lines, through a telecommunications network for remote diagnosis.

While a preferred embodiment of a diagnostic system in accordance with the present invention have been set forth fully and completely hereinabove, it will be apparent to one of skill in the art that a number of changes in, for example, the number of printing unit pairs, the specific drives for the cylinders in each printing unit, the type of web being printed and the like could be made without departing from the true spirit and scope of the present invention which is accordingly to be limited only by the following claims.

What is claimed is:

1. A diagnostic system for a rotary printing press comprising:

at least first and second periodically and synchronously rotating press components;

first and second position detectors attached to said first and second press components and generating first and second output signals; and an analyzing system for receiving said first and second output signals as a relative motion signal and comparing this relative motion signal to a press-idiosyncratic signal stored in said analyzing system, changes in said comparison being used as a measure of wear of said press components.

2. The diagnostic system of claim 1 wherein said output signal and said reference signal are resolved into frequency spectra and further wherein selected frequencies of said frequency spectra are used as said measure of wear.

3. The diagnostic system of claim 2 wherein said frequency spectra are determined in relation to cylinder revolutions.

4. The diagnostic system of claim 1 further including a plurality of printing units, each of said units having said at least first and second press component.

5. The diagnostic system of claim 1 further including a plurality of printing units, each of said units having said at least first press components.

6. The diagnostic system of claim 1 further including a cutting cylinder in a folding apparatus of said rotary printing press, said cutting cylinder having a cutting cylinder position detector usable to analyze cutting progress in said cutting cylinder.

7. The diagnostic system of claim 1 further including a drive motor associated with each of said at least first and second press components, each of said drive motors having an associated angular position detector providing said output signals.

8. The diagnostic system of claim 1 wherein said analyzing system includes a plurality of measurement cards associated with said first and second position detectors, a time base, a control unit and a data storage, said analyzing system interfacing with a computer.

9. A diagnostic system for a rotary printing press comprising:

at least a first rotating press component;

an angular position detector secured to said press component to generate an output signal indicative of an angular position of said press component; and an analyzing system for receiving said output signal and comparing said output signal with a press-idiosyncratic reference signal stored in said analyzing system, changes in said output signal from said reference signal being used as a measure of wear of the rotary printing press.

10. A diagnostic system for a rotary printing press comprising:

at least one printing unit having at least one cylinder;

a position-regulated drive motor for said at least one cylinder;

an angular position detector for controlling said drive motor and having an output signal; and means using said output signal to diagnose wear of the rotary printing press.

11. A method for diagnosing wear of a rotary printing press having a plurality of rotary components including:

positioning an angular position detector on at least one rotary component of the rotary printing press;

generating an output signal representing an angular position of said at least one rotating component using said angular position detector,;

providing an analyzing system;

storing a press-idiosyncratic reference signal in said analyzing system;

directing said output signal to said analyzing system;

comparing said output signal and said press idiosyncratic reference signal;

noting deviations between said output signal and said reference signal; and using said noted deviations as a measure of wear of said rotary printing press.

* * * * *